US008818231B2

(12) United States Patent
Yamashita et al.

(10) Patent No.: US 8,818,231 B2
(45) Date of Patent: Aug. 26, 2014

(54) IMAGE FORMING APPARATUS

(71) Applicant: Kyocera Document Solutions Inc., Osaka (JP)

(72) Inventors: Kazuya Yamashita, Osaka (JP); Masami Fuchi, Osaka (JP)

(73) Assignee: Kyocera Document Solutions, Inc., Osaka (JP)

( * ) Notice: Subject to any disclaimer, the term of this patent is extended or adjusted under 35 U.S.C. 154(b) by 65 days.

(21) Appl. No.: 13/785,243

(22) Filed: Mar. 5, 2013

(65) Prior Publication Data

US 2013/0243472 A1 Sep. 19, 2013

(30) Foreign Application Priority Data

Mar. 14, 2012 (JP) ..... 2012-056714

(51) Int. Cl.
*G03G 21/00* (2006.01)
*G03G 15/08* (2006.01)
*G03G 21/20* (2006.01)

(52) U.S. Cl.
CPC ..... *G03G 15/0898* (2013.01); *G03G 21/206* (2013.01)
USPC ..... 399/98; 399/119

(58) Field of Classification Search
USPC ..... 399/91–93, 98, 107, 110, 119, 120
See application file for complete search history.

(56) References Cited

U.S. PATENT DOCUMENTS 7,340,195 B2 * 3/2008 Watanabe et al. ..... 399/99
7,848,666 B2 * 12/2010 Onishi ..... 399/27

FOREIGN PATENT DOCUMENTS

JP 4-13961 2/1992
JP 2000-047484 2/2000
JP 2003-167426 6/2003

* cited by examiner

*Primary Examiner* — Hoan Tran
(74) *Attorney, Agent, or Firm* — Morgan, Lewis & Bockius LLP

(57) ABSTRACT

An image forming apparatus includes a developing device, a duct, a first fan, a dust collection part, and a connection portion. The duct communicates with a suction port that is provided in the vicinity of an opening portion of a developing container of the developing device. The first fan generates an airflow in the duct and discharges air that has passed through the suction port and through the duct to the outside of a main body of the apparatus. The dust collection part captures toner that has passed through the duct together with an airflow generated by the first fan. The connection portion is provided at some point along a length of the duct, can store part of toner that passes therethrough together with an airflow, and has a lid portion that is openable and closable with respect to a main body of the connection portion.

7 Claims, 8 Drawing Sheets

IMAGE FORMING APPARATUS

INCORPORATION BY REFERENCE

This application is based on and claims the benefit of priority from Japanese Patent Application No. 2012-056714 filed on Mar. 14, 2012, the contents of which are hereby incorporated by reference.

BACKGROUND

The present disclosure relates to an image forming apparatus such as a copy machine, a printer, a facsimile, a multifunctional peripheral having functions of these apparatuses, or the like, and relates particularly to an image forming apparatus in which toner scattered at the time of toner supply to an image carrying member is collected.

In an image forming apparatus, an electrostatic latent image that is formed by irradiation of light related to image data onto a uniformly charged image carrying member is supplied with toner from a developing device so that a visible image is formed, and the visible image thus formed is transferred onto a recording medium and then is fixed, whereby image formation is performed. The developing device includes a developing roller that is disposed in a developing region opposed to the image carrying member and supplies toner carried on the developing roller onto the image carrying member. When toner is supplied from the developing device to the image carrying member, in some cases, part of the toner is scattered and leaks out from an opening portion of the developing device, which is opposed to the image carrying member, causing contamination inside the image forming apparatus.

In order to avoid this, in the image forming apparatus, at a position in the vicinity of the image carrying member and in contact with a lower side of the developing device, a suction port for sucking in scattered toner is provided, and a duct that communicates with the suction port further is provided. This duct communicates with a rear duct that is provided on a rear side in the image forming apparatus, and the rear duct is provided with a suction fan that sucks in air and toner at the suction port and a filter that captures the toner thus sucked in. Toner scattered in the vicinity of the developing region is sucked in together with air through the suction port and, after passing through the duct and through the rear duct, is captured on the filter, and thus contamination inside the image forming apparatus is prevented.

In the above-described image forming apparatus, however, as scattered toner is repeatedly sucked into the duct through the suction port, the toner is gradually deposited in the duct, so that the duct might be clogged with the deposited toner at some point along a flow path. This has led to a problem that the toner does not reach the side of a discharge port to which the filter is mounted. Particularly in a case where the flow path of the duct, which extends in an elongated manner, is bent at some point along its length, or at a narrowed portion of the flow path in the duct, clogging with the sucked toner is more likely to occur, leading to a problem that collection of scattered toner cannot be achieved.

It is an object of the present disclosure to provide an image forming apparatus in which a duct extending from the vicinity of a developing container to a dust collection part is prevented from being clogged with toner, and thus scattered toner is collected in an excellent manner.

SUMMARY

An image forming apparatus according to one aspect of the present disclosure includes a developing device, a duct, a first fan, a dust collection part, and a connection portion. The developing device includes a developing container that contains toner and a developing roller that is disposed so as to be opposed to an image carrying member, with part of an outer peripheral surface thereof exposed from an opening portion of said developing container, and supplies toner to the image carrying member. The duct communicates with a suction port that is provided in the vicinity of the opening portion of the developing container. The first fan generates an airflow in the duct and discharges air that has passed through the suction port and through the duct to the outside of a main body of the apparatus. The dust collection part captures toner that has passed through the duct together with an airflow generated by the first fan. The connection portion is provided at some point along a length of the duct, can store part of toner that passes therethrough together with an airflow, and has a lid portion that is openable and closable with respect to a main body of the connection portion.

Still other objects of the present disclosure and specific advantages provided by the present disclosure will be made further apparent from the following descriptions of embodiments.

DETAILED DESCRIPTION

The following describes embodiments of the present disclosure with reference to the appended drawings without limiting the present disclosure thereto. Furthermore, an intended use of the disclosure and terms and so on included in the following description are not to be construed as limiting.

First Embodiment

Figure 1:
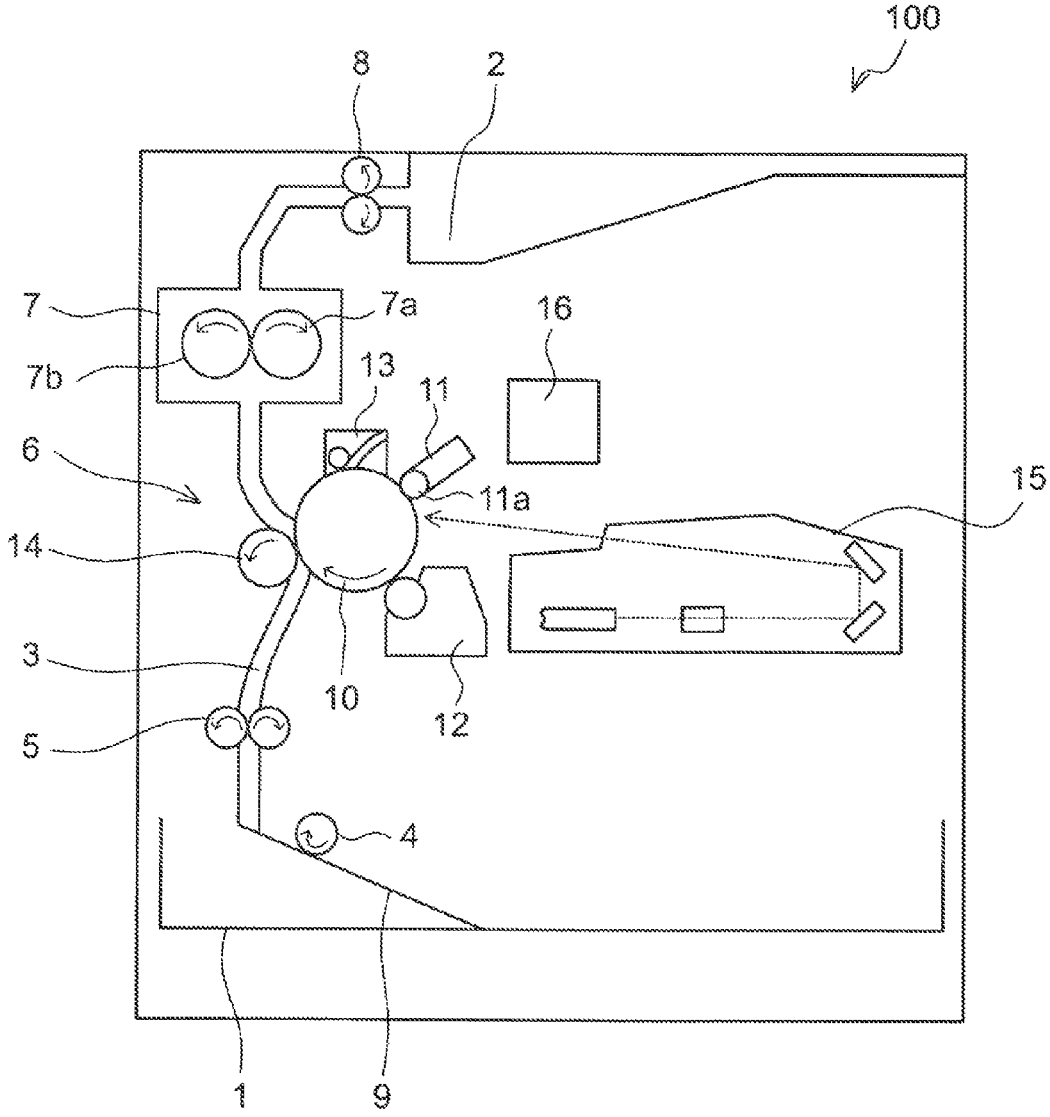
FIG. 1 is a schematic configuration view showing an image forming apparatus according to a first embodiment of the present disclosure.

FIG. 1 is a sectional view showing a schematic configuration of an image forming apparatus as an embodiment of the present disclosure, where a right side in the view corresponds to a front side of the image forming apparatus. At a lower portion of an image forming apparatus 100, a paper feed cassette 1 that houses therein a stack of paper sheets is disposed. A paper sheet conveying path 3 extending upward to reach a paper ejection part 2 that is formed on an upper surface of an apparatus main body is formed rearward of the paper feed cassette 1. In order from an upstream side along the paper sheet conveying path 3, a pick-up roller 4, a registration roller pair 5, an image forming part 6, a fixing part 7, and an ejection roller pair 8 are disposed.

In the paper feed cassette 1, there is provided a paper sheet stacking plate 9 that is supported so as to be pivotable with respect to the paper feed cassette 1. By the pick-up roller 4, paper sheets stacked on the paper sheet stacking plate 9 are fed out one by one toward the paper sheet conveying path 3. A paper sheet thus fed out to the paper sheet conveying path 3 is conveyed to the registration roller pair 5 by which timing for supplying it to the image forming part 6 is adjusted, and the paper sheet is then supplied to the image forming part 6 at the adjusted timing.

The image forming part 6 forms a prescribed toner image on a paper sheet by an electrophotographic process. The image forming part 6 is composed of a photosensitive member 10 that is an image carrying member which is axially supported so as to be rotatable clockwise in FIG. 1, a charging device 11, a developing device 12, and a cleaning device 13 that are disposed on the periphery of the photosensitive member 10, a transfer roller 14 that is disposed so as to be opposed to the photosensitive member 10 across the paper sheet conveying path 3, and an optical scanning device 15 that is disposed forward of the photosensitive member 10. Above the developing device 12, a toner container 16 that replenishes the developing device 12 with toner is disposed.

The charging device 11 includes an electrically conductive rubber roller 11*a* and is disposed such that the electrically conductive rubber roller 11*a* is in contact with the photosensitive member 10. When the photosensitive member 10 rotates, the electrically conductive rubber roller 11*a*, while being in contact with the surface of the photosensitive member 10, rotates following the rotation of the photosensitive member 10, and at this time, a prescribed voltage is applied to the electrically conductive rubber roller 11*a*, so that the surface of the photosensitive member 10 becomes uniformly charged.

Subsequently, by beam light emitted from the optical scanning device 15, an electrostatic latent image based on inputted image data is formed on the photosensitive member 10. Toner supplied from the developing device 12 adheres to this electrostatic latent image, and thus a toner image is on the surface of the photosensitive member 10. Then, from the registration roller pair 5, a paper sheet is supplied at prescribed timing to a nip portion (transfer position) between the photosensitive member 10 and the transfer roller 14, at which the toner image on the surface of the photosensitive member 10 is transferred onto the paper sheet by the transfer roller 14.

The paper sheet onto which the toner image has been transferred is separated from the photosensitive member 10 and is conveyed toward the fixing part 7. The fixing part 7 is disposed on a downstream side of the image forming part 6 in a paper sheet conveying direction and includes a heating roller 7*a* and a pressing roller 7*b* that is brought in press contact with the heating roller 7*a*. The paper sheet onto which the toner image has been transferred is heated by the heating roller 7*a* and pressed by the pressing roller 7*b*, and thus the toner image that has been transferred onto the paper sheet is fixed.

The paper sheet that has thus undergone image formation is ejected to the paper ejection part 2 by the ejection roller pair 8. Meanwhile, residual toner remaining on the surface of the photosensitive member 10 after the image transfer is removed by the cleaning device 13, and the photosensitive member 10 is charged again by the charging device 11 for subsequent image formation that is performed in a similar manner.

Figure 2:
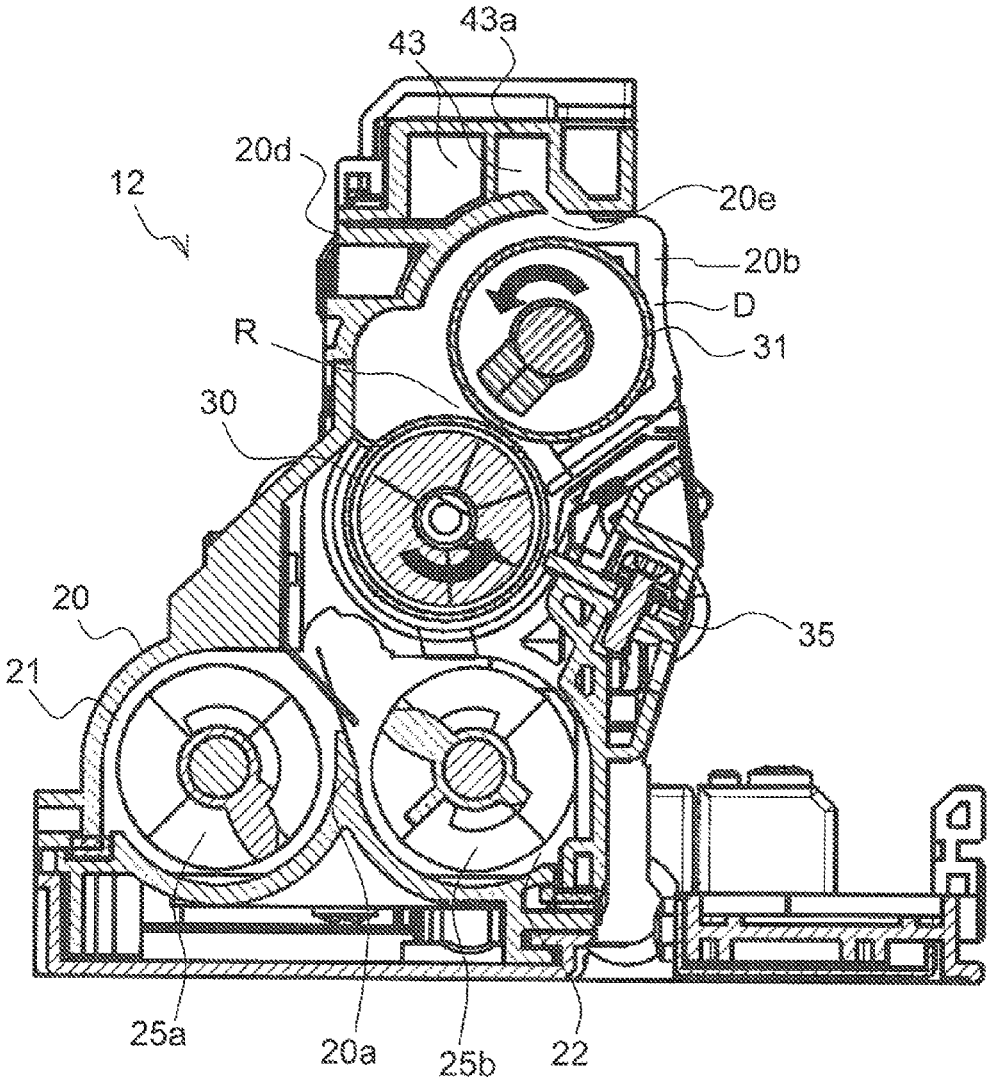
FIG. 2 is a side sectional view showing a developing device according to the first embodiment of the present disclosure.
Figure 3:
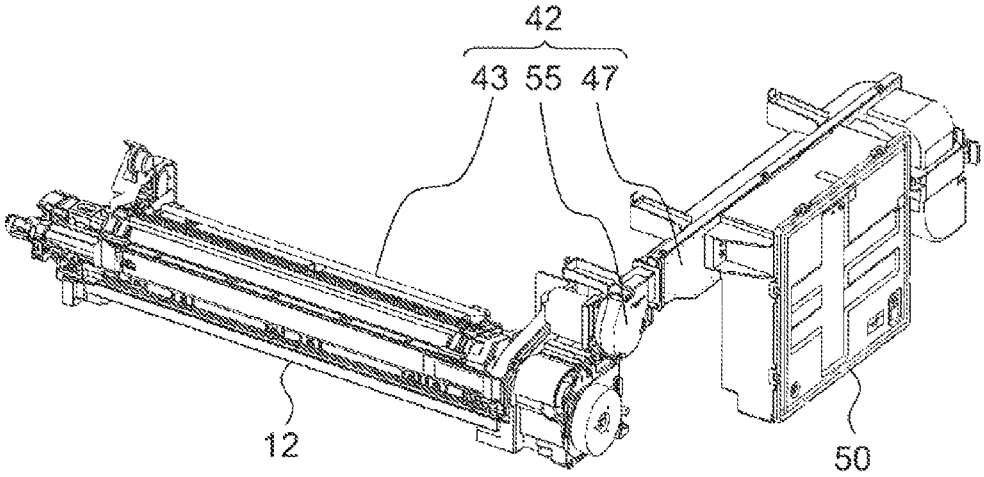
FIG. 3 is a perspective view showing a flow path from the developing device to a dust collection part according to the first embodiment of the present disclosure.
Figure 4:
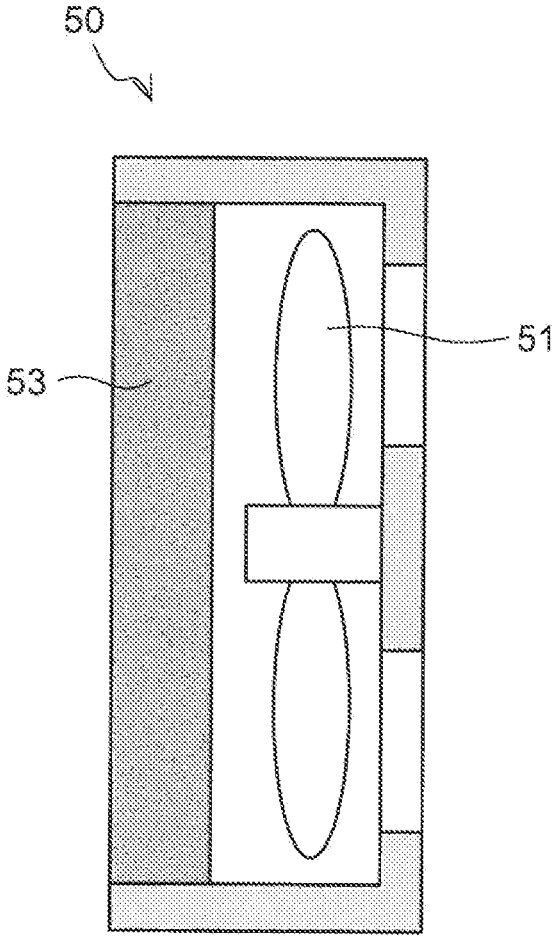
FIG. 4 is a sectional view schematically showing the dust collection part according to the first embodiment of the present disclosure.

FIGS. 2 to 4 show respective configurations of the developing device 12 that is incorporated in the above-described image forming apparatus 100, a dust collection part 50 that collects toner, and a flow path from the developing device 12 to the dust collection part 50. FIG. 2 is a side sectional view of the developing device 12, FIG. 3 is a perspective view showing the flow path from the developing device 12 to the dust collection part 50, and FIG. 4 is a schematic sectional view of the dust collection part 50. In FIG. 2, a state as seen from a back surface side of FIG. 1 is shown, and constituent members of the developing device 12, therefore, are shown to be mirror-reversed from their state of being disposed in FIG. 1.

As shown in FIG. 2, the developing device 12 includes a developing container 20 in which a two-component developer (hereinafter, referred to simply as a developer) including magnetic carriers and toner is contained, and the developing container 20 is partitioned with a partition wall 20*a* into a stirring/conveying chamber 21 and a supplying/conveying chamber 22. In the stirring/conveying chamber 21 and the supplying/conveying chamber 22, a stirring/conveying screw 25*a* and a supplying/conveying screw 25*b* are rotatably provided, respectively, which are used to mix toner supplied from the toner container 16 (see FIG. 1) with magnetic carriers and to stir a mixture thus obtained so that the toner becomes charged.

By the stirring/conveying screw 25*a* and the supplying/conveying screw 25*b*, the developer is conveyed, while being stirred, in an axial direction (front and back direction of the sheet of FIG. 2) and circulates between the stirring/conveying chamber 21 and the supplying/conveying chamber 22 via an unshown developer passing path that is formed at each of both end portions of the partition wall 20*a*. That is, in the developing container 20, the stirring/conveying chamber 21, the supplying/conveying chamber 22, and the developer passing path form a circulation path of the developer.

The developing container 20 extends obliquely upward to the right in FIG. 2. In the developing container 20, a magnetic roller 30 is disposed above the supplying/conveying screw 25*b*, and a developing roller 31 is disposed obliquely upward to the right relative to the magnetic roller 30 so as to be opposed to the magnetic roller 30. Part of an outer peripheral surface of the developing roller 31 is exposed from an opening portion 20*b* of the developing container 20 and is opposed to the photosensitive member 10 (see FIG. 1). Each of the magnetic roller 30 and the developing roller 31 rotates in a counterclockwise direction in FIG. 2.

The magnetic roller 30 is composed of a non-magnetic rotary sleeve that rotates in the counterclockwise direction in FIG. 2 and a stationary magnet body that is embedded in the rotary sleeve and has a plurality of magnetic poles.

The developing roller 31 is composed of a cylindrical developing sleeve that rotates in the counterclockwise direction in FIG. 2 and a developing roller side magnetic pole that is fixed in the developing sleeve, and the magnetic roller 30 and the developing roller 31 are opposed to each other via a prescribed gap at an opposition position R therebetween. The developing roller side magnetic pole is opposite in polarity to the magnetic poles of the stationary magnet body of the magnetic roller 30, which are opposed thereto.

Furthermore, in the developing container 20, an ear cutting blade 35 is mounted along a longitudinal direction of the magnetic roller 30 (front and back direction of the sheet of FIG. 2) and is disposed on an upstream side in a rotation direction of the magnetic roller 30 (counterclockwise direction in FIG. 2) with respect to the opposition position R where the developing roller 31 and the magnetic roller 30 are opposed to each other. A minute gap is formed between a tip end portion of the ear cutting blade 35 and the surface of the magnetic roller 30.

A direct current voltage and an alternating current voltage are applied to the developing roller 31, and a direct current voltage and an alternating current voltage are applied to the magnetic roller 30. A direct current voltage and an alternating current voltage used in this case are applied from a developing bias power source via a bias control circuit (neither of these are shown) to each of the respective sleeves of the developing roller 31 and the magnetic roller 30.

The rotations of the stirring/conveying screw 25*a* and the supplying/conveying screw 25*b* cause the developer to circulate, while being stirred, between the stirring/conveying chamber 21 and the supplying/conveying chamber 22 in the developing container 20. Through the stirring and circulation of the developer, toner becomes charged, and the developer including the toner thus charged is conveyed to the magnetic roller 30 by the supplying/conveying screw 25*b*. The developer thus carried on the magnetic roller 30 forms a magnetic brush (not shown). The magnetic bush, after being subjected to layer restriction by the ear cutting blade 35, is conveyed to the opposition position R. At the opposition position R, due to a potential difference between a bias applied to the magnetic roller 30 and a bias applied to the developing roller 31 and due to respective magnetic fields of the magnetic roller 30 and the developing roller 31, only toner in the magnetic brush is supplied to the developing roller 31 to form a toner thin layer on the developing roller 31.

By the rotation of the developing roller 31, the toner thin layer thus carried on the developing roller 31 is conveyed to an opposition position (developing region D) where the photosensitive member 10 (see FIG. 1) and the developing roller 31 are opposed to each other. Since a prescribed bias has been applied to the developing roller 31, due to a potential difference between the developing roller 31 and the photosensitive member 10 (see FIG. 1), toner flies therefrom, so that an electrostatic latent image on the photosensitive member 10 (see FIG. 1) is developed with the toner.

By the rotation of the developing roller 31, residual toner remaining on the developing roller 31 without being used for the development is conveyed again to the opposition position R and is collected by a magnetic brush on the magnetic roller 30. The magnetic brush is ripped off from the magnetic roller 30 at a portion thereof at which the stationary magnet body of the magnetic roller 30 has the same polarity as that of the magnetic brush and then drops into the supplying/conveying chamber 22.

Furthermore, a first duct 43 is disposed over the developing container 20. The first duct 43 is constituted by an upper end portion 20*d* of the developing container 20 and a duct cover 43*a* that is mounted to the first duct 43.

Furthermore, at the upper end portion 20*d* of the developing container 20, in the vicinity of the opening portion 20*b*, there is formed an air outlet port 20*e* that is a suction port. The air outlet port 20*e* is an opening that is disposed so as to be opposed to the outer peripheral surface of the developing roller 31, and a plurality of them are formed through the upper end portion 20*d* along a longitudinal direction of the developing container 20. Furthermore, the air outlet port 20*e* is provided to communicate with the inside of the first duct 43 and is configured to discharge air and floating toner in the developing container 20 into the first duct 43. In some cases, part of residual toner remaining on the developing roller 31 without being used for development fails to be collected at the opposition position R by a magnetic brush to the side of the magnetic roller 30 and floats in the developing container 20, and this floating toner leaks out to the outside through the opening portion 20*b*. Herein, such floating toner and toner leaking out are referred to collectively as scattered toner.

As shown in FIG. 3, the first duct 43 is provided over the developing container 20 (see FIG. 2) so as to extend in a longitudinal direction. A second duct 47 is connected to the first duct 43 via a connection portion 55. The first duct 43, the second duct 47, and the connection portion 55 constitute a duct 42.

The first duct 43 is provided to extend to the sides of side surfaces (from the left side to the right side in FIG. 3) of the apparatus main body of the image forming apparatus 100 (see FIG. 1). The second duct 47 is provided to extend along one of the side surfaces of the apparatus main body so as to be bent at a right angle from the first duct 43 and is connected further to the dust collection part 50. The connection portion 55 connects the first duct 43 to the second duct 47 so as to allow communication through the duct and is provided in the vicinity of a bent portion where the first duct 43 and the second duct 47 are thus bent from each other.

As shown in FIG. 4, in the dust collection part 50, a first fan 51 and a first filter 53 are provided. The first fan 51 is an axial fan that sucks in air in the duct 42 (see FIG. 3). By the first fan 51, air in the developing container 20 (see FIG. 2) is sucked into the first duct 43 (see FIG. 3) through the air outlet port 20*e* (see FIG. 2) and further passes through a flow path in the first duct 43 (see FIG. 3), the connection portion 55 (see FIG. 3), and the second duct 47 (duct 42, see FIG. 3) to be sucked eventually into the dust collection part 50. The air thus sucked in is discharged from the dust collection part 50 to the outside of the image forming apparatus 100 (see FIG. 1).

The first filter 53 is provided on an upstream side of an airflow of the first fan 51. By the first fan 51, toner sucked in together with air through the air outlet port 20*e* (see FIG. 2) of the developing container 20 (see FIG. 2) is captured by the first filter 53. When, as a result of repeated image formation, a prescribed amount of toner has adhered to the first filter 53, the first filter 53 is replaced with a new one so that the toner is collected, and thus there is no possibility of causing contamination outside the image forming apparatus 100 (see FIG. 1).

Figure 5:
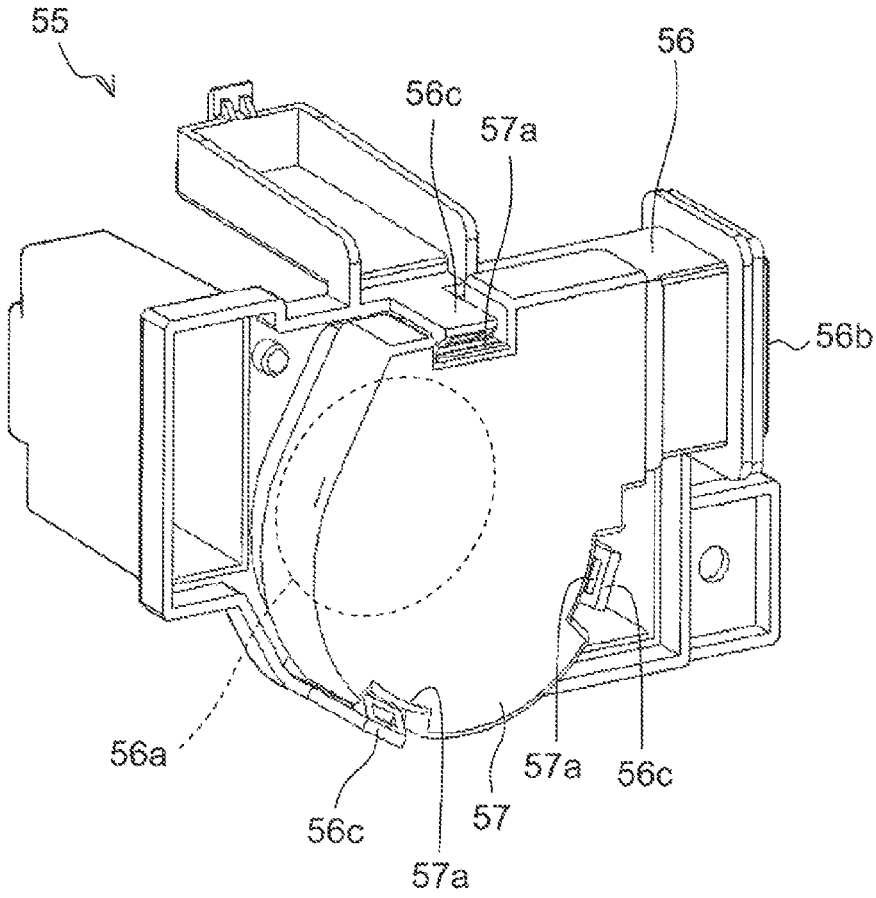
FIG. 5 is a perspective view showing a connection portion according to the first embodiment of the present disclosure.
Figure 6:
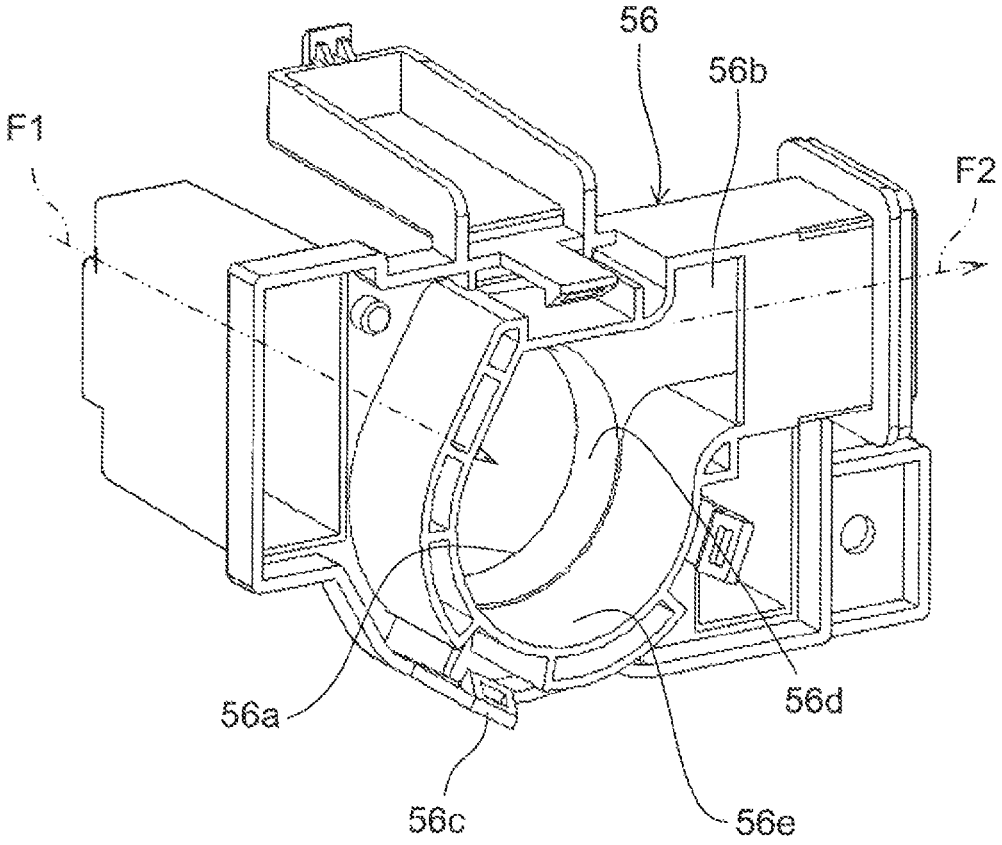
FIG. 6 is a perspective view showing a main body of the connection portion according to the first embodiment of the present disclosure in a state where a lid portion has been dismounted therefrom.
Figure 7:
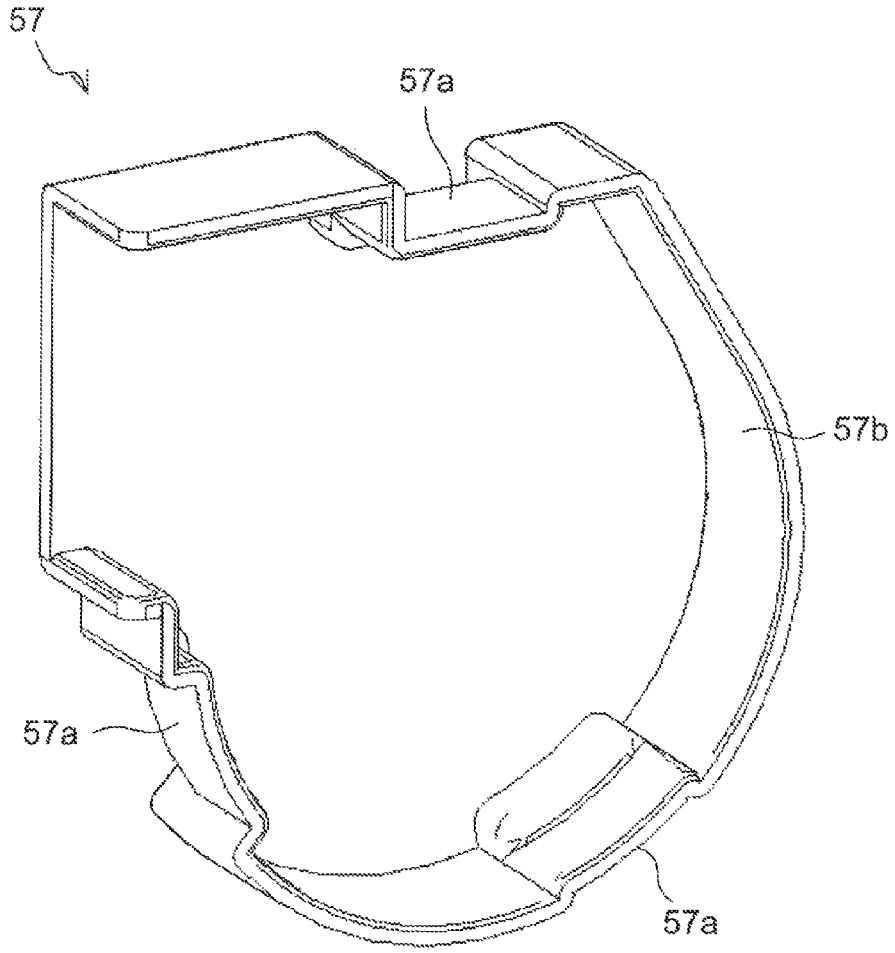
FIG. 7 is a perspective view showing the lid portion of the connection portion according to the first embodiment of the present disclosure.

FIGS. 5 to 7 show a detailed configuration of the connection portion 55. FIG. 5 is a perspective view of the connection portion 55, FIG. 6 is a perspective view of a main body 56 of the connection portion 55 in a state where a lid portion 57 has been dismounted therefrom, and FIG. 7 is a perspective view of the lid portion 57 of the connection portion 55.

As shown in FIG. 5, the connection portion 55 has the main body 56 made of resin or the like and the lid portion 57 that is made of resin or the like and is mountable and dismountable with respect to the main body 56.

The main body 56 has an upstream side opening portion 56*a* that is connected to the first duct 43 (see FIG. 3) and a downstream side opening portion 56*b* that has an opening formed in a direction orthogonal to an opening of the upstream side opening portion 56*a*. The downstream side opening portion 56*b* is connected to the second duct 47 (see FIG. 3), and when the first fan 51 (see FIG. 4) is driven to rotate, by the first fan 51, air and toner are caused to pass through the connection portion 55 in the order of a flow path F1 (see FIG. 6) and a flow path F2 (see FIG. 6) in a direction orthogonal to the flow path F1.

Furthermore, the main body 56 has a plurality of (in this embodiment, three) engagement lugs 56*c*, and the engagement lugs 56*c* are configured to be engageable with a plurality of protrusions 57*a* formed at the lid portion 57, respectively. In a case of dismounting the lid portion 57 from the main body 56, in a state where the plurality of engagement lugs 56*c* are elastically deformed to be outwardly expanded under pressure, the lid portion 57 is separated from the main body 56 toward the front (right side in FIG. 5) and thus is dismounted therefrom. With the lid portion 57 dismounted from the main body 56 so that the inside of the connection portion 55 is opened, toner deposited in the connection portion 55 can be collected.

As shown in FIG. 6, in the main body 56, there is formed a flow portion 56*d* composed of the flow path F1 and the flow path F2, which are described above. The flow portion 56*d* is formed on an upper side in the main body 56, and a circular arc-shaped reservoir portion 56*e* is formed on a lower side of the flow portion 56*d*.

By the first fan 51 (see FIG. 4), toner is caused to flow in through the upstream side opening portion 56*a*, and it then flows out through the downstream side opening portion 56*b* and is collected in the dust collection part 50 (see FIG. 3) via the second duct 47 (see FIG. 3). It is, however, not the entirety of the toner that is collected in the dust collection part 50 (see FIG. 3) by the first fan 51 (see FIG. 4). In fact, at a portion where the flow path F1 and the flow path F2 are bent from each other, the flow direction of an airflow generated by the first fan 51 (see FIG. 4) changes, so that toner is likely to be accumulated. The reservoir portion 56*e* is intended to contain such accumulated toner. As image formation is repeatedly performed, toner is gradually deposited in the reservoir portion 56*e*. Periodically, for example, after every prescribed number of times of printing, with the lid portion 57 (see FIG. 5) of the connection portion 55 (see FIG. 5) opened, such toner deposited in the reservoir portion 56*e* is collected, so that the duct 42 (see FIG. 3) is prevented from being clogged with toner, and toner can be collected in an excellent manner.

As shown in FIG. 7, the lid portion 57 has a flange portion 57*b* formed on the periphery thereof, and at an outer peripheral portion of the flange portion 57*b*, the protrusions 57*a* engageable with the engagement lugs 56*c* (see FIG. 6) of the main body 56 (see FIG. 6) are formed. The lid portion 57 is fitted such that an inner peripheral surface of the flange portion 57*b* is in intimate contact with an outer peripheral surface of the main body 56, and thus toner deposited in the reservoir portion 56*e* (see FIG. 6) of the main body 56 and toner passing through the connection potion 55 (see FIG. 5) are prevented from leaking out. In a case of collecting toner deposited in the connection portion 55 (see FIG. 5), with the lid portion 57 dismounted from the main body 56 (see FIG. 6), toner deposited in the reservoir portion 56*e* (see FIG. 6) of the main body 56 is removed, and the lid portion 57 having the flange portion 57*b* is used to contain the toner thus removed, so that the toner can be collected without causing contamination on the periphery of the connection portion 55 (see FIG. 5). A configuration also may be adopted in which an outer peripheral surface of the flange portion 57*b* is inwardly fitted to an inner peripheral surface of the main body 56 (see FIG. 6) such that the flange portion 57*b* is housed in the connection portion 55 (see FIG. 5). In this configuration, as image formation is repeatedly performed, toner is deposited at the flange portion 57*b*, and thus when the lid portion 57 is dismounted from the main body 56 (see FIG. 6), the toner is directly contained in the lid portion 57, so that a toner collecting operation is facilitated.

Second Embodiment

Figure 8:
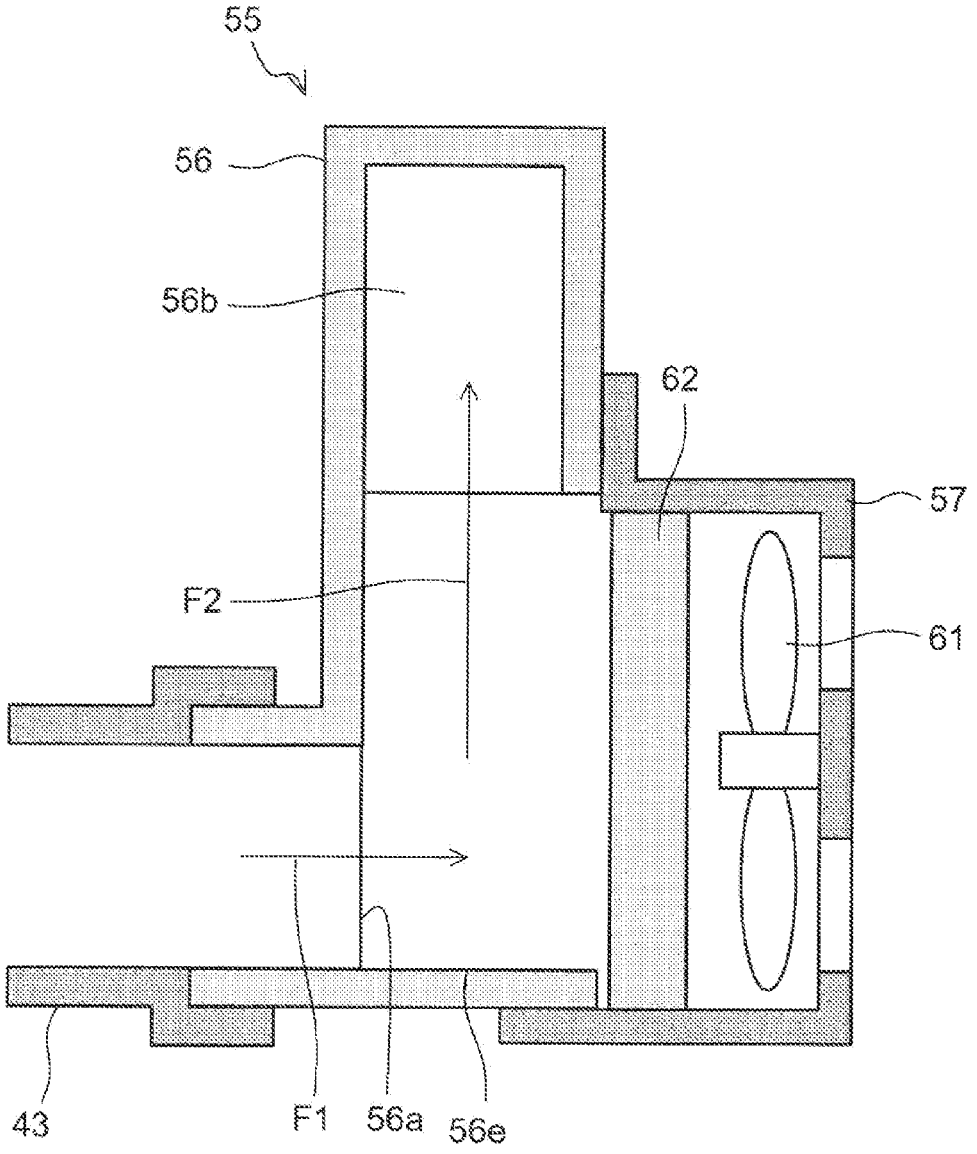
FIG. 8 is a sectional view schematically showing a connection portion according to a second embodiment of the present disclosure.

FIG. 8 is a sectional view schematically showing a connection portion 55 according to a second embodiment of the present disclosure. In the second embodiment, a fan and a filter are provided also in a lid portion 57 in addition to those in the dust collection part 50 shown in FIG. 4. Herein, the lid portion 57 is mainly described in terms of differences from the first embodiment, and duplicate descriptions of the same parts as in the first embodiment are omitted.

In the connection portion 55, similarly to the first embodiment, by the first fan 51 (see FIG. 4) of the dust collection part 50 (see FIG. 4), toner is caused to flow into an upstream side opening portion 56*a* along a flow path F1 and flows out through a downstream side opening potion 56*b* along a flow path F2. The toner that has thus flowed out through the downstream side opening portion 56*b* is collected in the dust collection part 50 (see FIG. 3) via the second duct 47 (see FIG. 3).

By the first fan 51 (see FIG. 4), an airflow is generated in the first duct 43 (see FIG. 3) and in the second duct 47 (see FIG. 3) and causes toner to be collected in the dust collection part 50 (see FIG. 3). In order to supplementarily generate an airflow in the first duct 43 (see FIG. 3) disposed at a position relatively distant from the first fan 51 (see FIG. 4) so as to further enhance collection of toner in the first duct 43 (see FIG. 3), a second fan 61 and a second filter 62 are provided.

In the lid portion 57 of the connection portion 55, the second fan 61 and the second filter 62 are mounted. The second fan 61 is an axial fan that sucks in air in the first duct 43 and in the connection portion 55. By the second fan 61, air in the first duct 43 (see FIG. 3) and in the connection portion 55 is sucked in and discharged to an outer side of the connection portion 55. The second filter 62 is provided on an upstream side of an airflow of the second fan 61.

By the second fan 61 as well as by the first fan 51 (see FIG. 4), toner is sucked in together with air from inside the first duct 43 (see FIG. 3) and from inside the connection portion 55, and it then is captured by the second filter 62 and drops into a reservoir portion 56*e* of a main body 56.

The lid portion 57 is supported at an upper portion thereof with an unshown hinge or the like to the main body 56 of the connection portion 55 and is provided pivotably about the hinge.

As image formation is repeatedly performed, toner captured by the second filter 62 increases in amount, and the toner is deposited in the reservoir portion 56*e*. Periodically, for example, after every prescribed number of times of printing, with the lid portion 57 opened with respect to the main body 56 of the connection portion 55, the second filter 62 is replaced with a new one, and such toner deposited in the reservoir portion 56*e* is collected, so that the duct 42 (see FIG. 3) is prevented from being clogged with toner, and toner can be collected in an excellent manner.

In this embodiment, preferably, the connection portion 55 is disposed in the vicinity of a portion of the duct 42 at which the duct 42 is relatively reduced in sectional area, making it difficult for air to flow therethrough. In a case where, due to dispositions and configurations of the other constituent members of the image forming apparatus 100 (see FIG. 1), it is required that the first duct 43 (see FIG. 3) have a portion with a reduced sectional area or that the first duct 43 (see FIG. 3) have a sectional area smaller than that of the second duct 47 (see FIG. 3), as shown in FIG. 8, the connection portion 55 having the lid portion 57 that is openable and closable is provided in the vicinity of such a portion with a reduced sectional area or the first duct 43 (in this embodiment, on a downstream side of the first duct 43 (see FIG. 3) with a smaller sectional area). Compared with other portions of the duct 42 (see FIG. 3), the first duct 43 (see FIG. 3) with a reduced sectional area might become clogged with toner in a shorter period of time. With the above-described configuration, however, toner that might otherwise be deposited in the first duct 43 (see FIG. 3) with a reduced sectional area can be collected from the connection portion 55.

While each of the foregoing embodiments exemplarily shows that the present disclosure is applied to the developing device 12 based on a two-component developing method, which includes the developing roller 31 that is disposed in a noncontact manner with respect to the photosensitive member 10 and the magnetic roller 30 that forms a magnetic brush thereon, there is no limitation thereto. The present disclosure may be applied also to a case where the developing device 12 based on the two-component developing method has a configuration in which a two-component developer including toner and magnetic carriers is carried as a magnetic brush on the surface of the developing roller, and an electrostatic latent image on the photosensitive member 10 is developed with the toner in the magnetic brush. Furthermore, the present disclosure may be applied also to a case where the developing device 12 is based on a one-component developing method that does not use carriers.

Furthermore, while each of the foregoing embodiments shows the configuration in which toner floating in the developing container 20 is collected by using, as a suction port, the air outlet port 20*e* that is formed at the upper end portion 20*d* of the developing container 20, the present disclosure is not limited thereto. As for a suction port, as long as the suction port is disposed in the vicinity of the opening portion 20*b* of the developing container 20, it may be provided on an outer side of the developing container 20 integrally with or separately from the developing container 20 and be configured to collect toner leaking out from the developing container 20 to the outside. Furthermore, when the present disclosure is applied to a case where in the image forming apparatus 100, the developing device 12 is disposed on an upper side with respect to the photosensitive member 10, it is favorable that such a suction port is disposed on a lower side in the developing container 20. This also provides similar effects to those of the foregoing embodiments.

Furthermore, while each of the foregoing embodiments shows the configuration in which the connection portion 55 is disposed in the vicinity of the bent portion where the first duct 43 and the second duct 47 are bent from each other or in the vicinity of a portion of the duct 42 with a reduced sectional area, the present disclosure is not limited thereto. The duct 42 may be configured to be linear. Furthermore, even in a case where the duct 42 has a sectional area that does not vary largely, where appropriate, the connection portion 55 can be provided at a portion of the duct at which toner might be accumulated.

The present disclosure is applicable to an image forming apparatus such as a copy machine, a printer, a facsimile, a functional peripheral having functions of these apparatuses, or the like, and is applicable particularly to an image forming apparatus in which toner scattered at the time of toner supply to an image carrying member is collected.

What is claimed is:

1. An image forming apparatus, comprising:

a developing device that includes:

a developing container that contains toner; and a developing roller that is disposed so as to be opposed to an image carrying member, with part of an outer peripheral surface thereof exposed from an opening portion of said developing container, and supplies toner to the image carrying member;

a duct that communicates with a suction port that is provided in a vicinity of the opening portion of the developing container;

a first fan that generates an airflow in said duct and discharges air that has passed through the suction port and through the duct to an outside of a main body of the apparatus;

a dust collection part that captures toner that has passed through the duct together with an airflow generated by said first fan; and a connection portion that is provided at some point along a length of the duct, can store part of toner that passes therethrough together with an airflow, and has a main body and a lid portion that is openable and closable with respect to said main body.

2. The image forming apparatus according to claim 1, wherein the duct has a first duct that communicates with the suction port and is provided along a longitudinal direction of the developing container and a second duct that extends so as to be bent from said first duct and communicates with the dust collection part, and the connection portion is disposed in a vicinity of a bent portion where the first duct and the second duct are bent from each other.

3. The image forming apparatus according to claim 1, wherein the connection portion is disposed in a vicinity of a portion of the duct at which the duct has a sectional area smaller compared with that at other portions of the duct.

4. The image forming apparatus according to claim 1, wherein the main body of the connection portion has a flow portion through which toner passes toward the dust collection part and a reservoir portion that is provided on a lower side in said flow portion and in which part of toner is deposited.

5. The image forming apparatus according to claim 4, wherein the lid portion is provided mountably and dismountably with respect to the main body of the connection portion, and in the lid portion, a flange portion is formed at which, when the lid portion is dismounted, toner deposited in the reservoir portion is containable.

6. The image forming apparatus according to claim 1, wherein the lid portion is provided with a second fan that sucks in air in the connection portion toward the lid portion and generates an airflow directed toward an outside of the connection portion and a filter that captures toner that passes through the connection portion together with an airflow generated by said second fan.

7. The image forming apparatus according to claim 1, wherein the suction port is an opening that is formed on an upper side in the developing container and is disposed along a longitudinal direction of the developing container.

* * * * *